US008948901B2

(12) United States Patent
Tokura

(10) Patent No.: US 8,948,901 B2
(45) Date of Patent: Feb. 3, 2015

(54) SEWING MACHINE

(71) Applicant: Masashi Tokura, Konan (JP)

(72) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/026,672

(22) Filed: Sep. 13, 2013

(65) Prior Publication Data

US 2014/0083345 A1 Mar. 27, 2014

(30) Foreign Application Priority Data

Sep. 25, 2012 (JP) ..... 2012-210940

(51) Int. Cl.

| | |
|---|---|
| ***D05B 21/00*** | (2006.01) |
| ***D05B 19/02*** | (2006.01) |
| ***D05B 19/08*** | (2006.01) |
| ***D05C 5/06*** | (2006.01) |

(52) U.S. Cl.

CPC ..... *D05B 19/02* (2013.01); *D05B 19/08* (2013.01); *D05C 5/06* (2013.01)

USPC ..... 700/138; 112/470.03; 112/102.5

(58) Field of Classification Search

USPC ..... 700/136–138; 112/475.18, 475.19, 112/102.5, 103, 470.01, 470.03

See application file for complete search history.

(56) References Cited

U.S. PATENT DOCUMENTS

| | | | | |
|---|---|---|---|---|
| 5,323,722 | A | 6/1994 | Goto et al. | |
| 8,738,173 | B2 * | 5/2014 | Tokura | 700/138 |
| 8,763,541 | B2 * | 7/2014 | Tokura | 112/102.5 |
| 8,763,542 | B2 * | 7/2014 | Abe et al. | 112/102.5 |
| 8,857,355 | B2 * | 10/2014 | Nomura et al. | 112/470.06 |
| 2014/0000498 | A1 * | 1/2014 | Yamanashi et al. | 112/102.5 |

FOREIGN PATENT DOCUMENTS

| | | |
|---|---|---|
| JP | A-5-68760 | 3/1993 |
| JP | U-5-48875 | 6/1993 |
| JP | A-8-158240 | 6/1996 |

* cited by examiner

*Primary Examiner* — Danny Worrell
(74) *Attorney, Agent, or Firm* — Oliff PLC

(57) ABSTRACT

A sewing machine includes an imaging device, a processor, and a memory configured to store sewing data and computer-readable instructions. The sewing data includes at least first stitch data to form first stitches that indicate a contour of a pattern on a first work cloth, and second stitch data to form second stitches that attach the pattern cut out along the first stitches onto a second work cloth. The computer-readable instructions cause the processor to perform processes comprising causing the imaging device to capture a first image, identifying a position and an angle of a marker in relation to the contour, causing the imaging device to capture a second image, identifying a position and an angle of the contour in relation to the second work cloth, and correcting the second stitch data in accordance with the identified position and angle of the contour in relation to the second work cloth.

6 Claims, 14 Drawing Sheets

SEWING MACHINE

CROSS-REFERENCE TO RELATED APPLICATION

This application claims priority to Japanese Patent Application No. 2012-210940, filed Sep. 25, 2012, the content of which is hereby incorporated herein by reference in its entirety.

BACKGROUND

The present disclosure relates to a sewing machine that is capable of sewing an applique pattern based on sewing data.

A sewing machine is known that is capable of sewing an applique pattern based on sewing data. For example, the sewing machine stores data to be used to form a plurality of types of stitches for applique sewing. A user first sets an applique material on an embroidery frame that is mounted on the sewing machine. Based on first data, the sewing machine forms, on the applique material, stitches that act as markers to cut out a contour of an applique piece. The user sets a base material in the embroidery frame in place of the applique material. Based on second data, the sewing machine forms, on the base material, stitches that form a guide position for positioning the applique piece. Taking the guide position stitches formed on the base material as markers, the user temporarily fixes the applique piece cut out from the applique material to the base material using adhesive. Based on third data, the sewing machine attaches the applique piece onto the base material by sewing. The applique sewing by the sewing machine can be completed in this manner.

SUMMARY

In the above-described sewing machine, the third data to be used to sew the applique piece onto the base material is set based on an assumption that the applique piece will be accurately positioned in relation to the guide position stitches. Thus, in a case where the user has not been able to accurately position the applique piece in relation to the guide position stitches, positions of the stitches for attaching the applique piece onto the base material may be misaligned in relation to the contour of the applique piece. Further, once the sewing machine forms the guide position stitches on the base material, it is not possible to change the position and angle at which the applique piece will be arranged in relation to the base material. As a result, the user may need to perform accurate positioning when setting the base material in the embroidery frame as well.

Various embodiments of the broad principles derived herein provide a sewing machine that allows a user to easily set a position and an angle of an applique piece in relation to a base material and sew the applique piece onto the base material in an accurate position.

Various embodiments herein provide a sewing machine that includes an imaging device configured to capture an image, a processor, and a memory. The memory is configured to store sewing data and computer-readable instructions. The sewing data includes at least first stitch data and second stitch data. The first stitch data is data to be used to form first stitches on a first work cloth. The first stitches are stitches that indicate a contour of a pattern. The second stitch data is data to be used to form second stitches. The second stitches are stitches that attach the pattern cut out from the first work cloth along the first stitches onto a second work cloth. The computer-readable instructions, when executed by the processor, cause the processor to perform processes. The processes include causing the imaging device to capture a first image, identifying, based on the first stitch data and on first image data, a position and an angle of a marker in relation to the contour, causing the imaging device to capture a second image, identifying, based on second image data and on the identified position and angle of the marker in relation to the contour, a position and an angle of the contour in relation to the second work cloth, and correcting the second stitch data in accordance with the identified position and angle of the contour in relation to the second work cloth. The first image is an image including the marker affixed inside the first stitches formed on the first work cloth based on the first stitch data. The first image data is image data of the first image. The second image is an image including the marker affixed to the pattern, wherein the pattern has been cut out from the first work cloth along the first stitches in a state in which the marker is affixed and wherein the pattern is temporarily fixed at a desired position and angle on the second work cloth. The second image data is image data of the second image.

Various embodiments also provide a sewing machine that includes an imaging device configured to capture an image, a processor, and a memory. The memory is configured to store sewing data and computer-readable instructions. The sewing data includes at least first stitch data and second stitch data. The first stitch data is data to be used to form first stitches on a first work cloth. The first stitches are stitches that indicate a contour of a pattern. The second stitch data is data to be used to form second stitches. The second stitches are stitches that attach the pattern cut out from the first work cloth along the first stitches onto a second work cloth. The computer-readable instructions, when executed by the processor, cause the processor to perform processes. The processes include causing the imaging device to capture a first image, identifying, based on the first stitch data and on first image data, a position and an angle, in relation to the contour, of at least two feature points on the first work cloth, the at least two feature points being inside the contour, causing the imaging device to capture a second image, identifying, based on second image data and on the identified position and angle of the at least two feature points in relation to the contour, a position and an angle of the contour in relation to the second work cloth, and correcting the second stitch data in accordance with the identified position and angle of the contour in relation to the second work cloth. The first image is an image including the first stitches formed on the first work cloth based on the first stitch data. The first image data is image data of the first image. The second image is an image including the at least two feature points in the pattern, wherein the pattern has been cut out from the first work cloth along the first stitches and wherein the pattern is temporarily fixed at a desired position and angle on the second work cloth. The second image data is image data of the second image.

Various embodiments further provide a sewing machine that includes an imaging device configured to capture an image, a processor, and a memory. The memory is configured to store sewing data and computer-readable instructions. The sewing data includes at least first stitch data and second stitch data. The first stitch data is data to be used to form at least first stitches on a first work cloth. The first stitches are stitches that indicate a contour of a pattern. The second stitch data is data to be used to form second stitches. The second stitches are stitches that attach the pattern cut out from the first work cloth along the first stitches onto a second work cloth. The computer-readable instructions, when executed by the processor, cause the processor to perform processes. The processes include causing the imaging device to capture a pattern image, identifying, in a case where the first stitch data only includes contour data to be used to form the first stitches on the first work cloth, a position and an angle of the contour in relation to the second work cloth based on the first stitch data and on image data of the pattern image, identifying, in a case where the first stitch data includes the contour data and internal pattern data to be used to form third stitches representing another pattern inside the contour, a position and an angle of the contour or the third stitches in relation to the second work cloth, based on the first stitch data and on the image data of the pattern image, and correcting the second stitch data in accordance with the identified position and angle of the contour or the third stitches in relation to the second work cloth. The pattern image is an image including the pattern, wherein the pattern has been cut out from the first work cloth along the first stitches formed on the first work cloth based on the first stitch data and wherein the pattern is temporarily fixed at a desired position and angle to the second work cloth.

BRIEF DESCRIPTION OF THE DRAWINGS

Embodiments will be described below in detail with reference to the accompanying drawings in which.

DETAILED DESCRIPTION

Hereinafter, embodiments will be explained with reference to the drawings. First, a physical configuration of a sewing machine 1 will be explained with reference to FIG. 1 and FIG. 2. The up-down direction, the front right direction, the rear left direction, the front left direction and the rear right direction of FIG. 1 are respectively the up-down direction, the front, the rear, the left and the right of the sewing machine 1.

Figure 1:
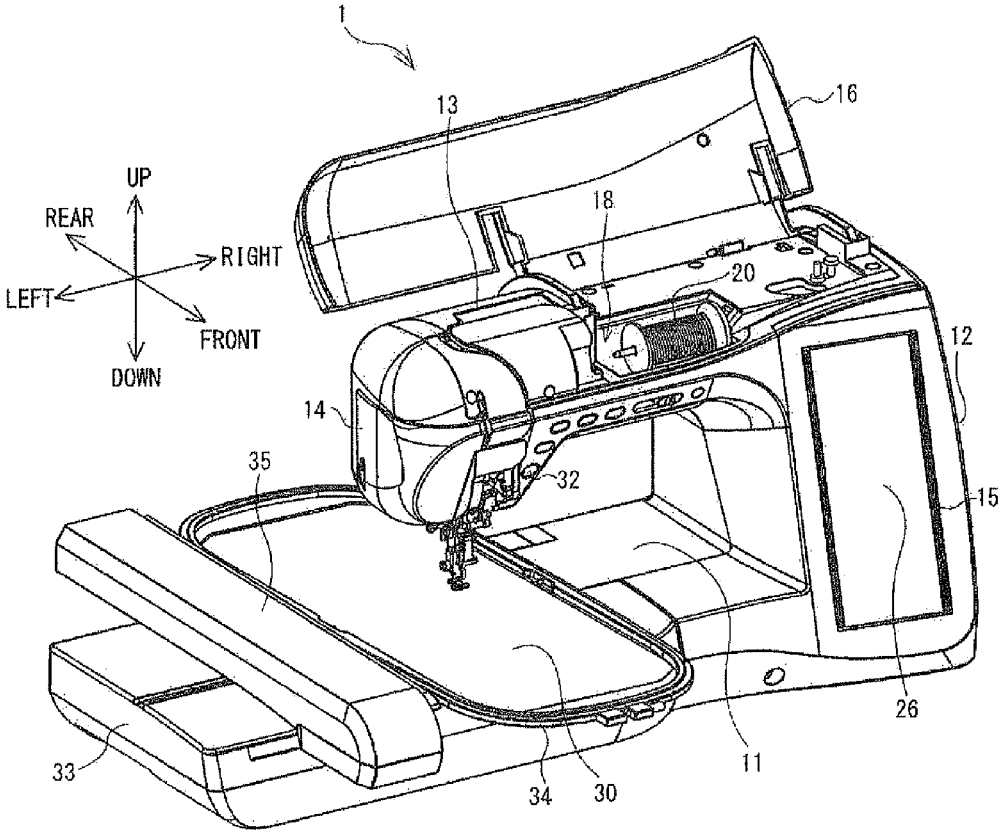
FIG. 1 is a perspective view of a sewing machine.

As shown in FIG. 1, the sewing machine 1 includes a bed portion 11, a pillar 12, an arm portion 13 and a head portion 14. The bed portion 11 is a base portion of the sewing machine 1 and extends in the left-right direction. The pillar 12 extends upward from the right end of the bed portion 11. The arm portion 13 extends to the left from the upper end of the pillar 12 such that the arm portion 13 faces the bed portion 11. The head portion 14 is a part that is coupled to the left end of the arm portion 13.

A needle plate (not shown in the drawings) that has a needle hole is disposed in a top face of the bed portion 11. A feed dog, a feed mechanism and a shuttle mechanism etc. (all of which are not shown in the drawings) are provided below the needle plate (namely, inside the bed portion 11). During normal sewing, which is not embroidery sewing, the feed dog is driven by the feed mechanism and moves a work cloth by a predetermined feed amount.

The bed potion 11 is configured such that a known frame moving device 33, which is used at a time of embroidery sewing, can be mounted on and detached from the bed portion 11. A box-shaped carriage 35 that is long in the front-rear direction is provided on an upper portion of the frame moving device 33. A frame holder (not shown in the drawings) is provided inside the carriage 35, along with a Y axis moving mechanism (not shown in the drawings) that is configured to move the frame holder in the front-rear direction (the Y axis direction). An embroidery frame 34, which is configured to hold a work cloth 30, can be detachably mounted on the frame holder. The embroidery frame 34 has a known structure in which the work cloth 30 is clamped between an inner frame and an outer frame. The Y axis moving mechanism may be driven by a Y axis motor 83 (refer to FIG. 3). The embroidery frame 34 may be moved in the front-rear direction (the Y axis direction) in accordance with the frame holder being moved in the front-rear direction (the Y axis direction).

An X axis moving mechanism (not shown in the drawings), which is configured to move the carriage 35 in the left-right direction (the X axis direction), is provided inside a main body of the frame moving device 33. The X axis moving mechanism may be driven by an X axis motor 82 (refer to FIG. 3). The embroidery frame 34 may be moved in the left-right direction (the X axis direction) in accordance with the carriage 35 being moved in the left-right direction (the X axis direction).

A rectangular liquid crystal display (hereinafter referred to as an LCD) 15, which is long in the up-down direction, is provided on a front surface of the pillar 12. The LCD 15 is configured to display an image that includes various items, such as commands, illustrations, setting values and messages. A touch panel 26 is provided on a front surface side of the LCD 15. When a user performs a pressing operation on the touch panel 26 using a finger or a dedicated touch pen, which item is selected can be recognized, corresponding to the pressed position detected by the touch panel 26. Hereinafter, the pressing operation of the touch panel 26 is referred to as a panel operation. Through the panel operation, the user can select a pattern to be sewn and a command to be executed.

A cover 16 that can open and close is provided on an upper portion of the arm portion 13. In FIG. 1, the cover 16 is in an open state. A thread housing portion 18 is provided below the cover 16, namely, inside the arm portion 13. The thread housing portion 18 is configured to house a thread spool 20 around which a needle thread is wound. A drive shaft (not shown in the drawings) that extends in the left-right direction is provided inside the arm portion 13. The drive shaft is driven to rotate by a sewing machine motor 81 (refer to FIG. 3). Various operation switches including a start/stop switch 32 are provided on a lower left portion of a front surface of the arm portion 13. The start/stop switch 32 may be operated to input a command to start or stop operation of the sewing machine 1, namely, a command to start or to stop sewing.

Figure 2:
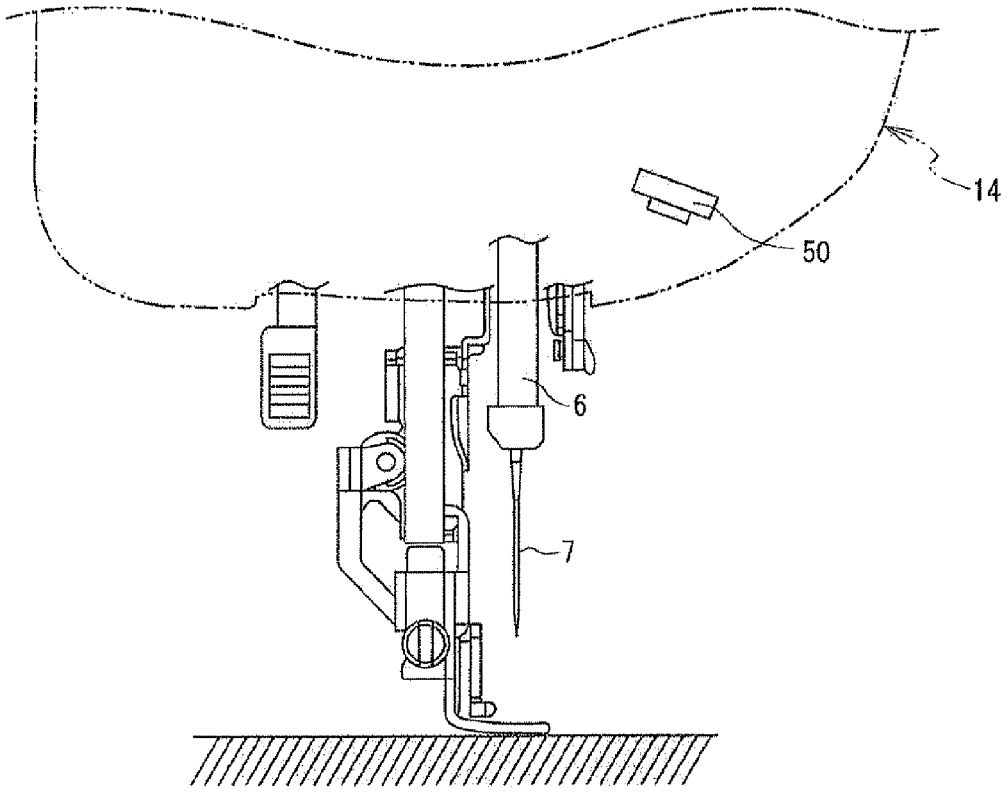
FIG. 2 is an explanatory diagram showing a lower end portion of a head portion and an internal configuration of the head portion.

As shown in FIG. 2, a needle bar 6 extends from a lower portion of the head portion 14. A sewing needle 7 may be detachably attached to the lower end portion of the needle bar 6. Further, an image sensor 50 is provided inside the head portion 14. The image sensor 50 may be, for example, a known complementary metal oxide semiconductor (CMOS) image sensor. The image sensor 50 is configured to capture an image of a predetermined image capture range, and to output image data of the captured image. The output image data may be stored in a predetermined storage area of a RAM 63. In addition, a needle bar up-and-down moving mechanism (not shown in the drawings), which is configured to move the needle bar 6 in the up-down direction in accordance with the rotation of the drive shaft, is provided inside the head portion 14.

During embroidery sewing, the needle bar drive mechanism and the shuttle mechanism are driven as the embroidery frame 34 is moved in the left-right direction (the X axis direction) and in the front-rear direction (the Y axis direction) by the frame moving device 33. In this manner, an embroidery pattern can be sewn on the work cloth 30, which is held by the embroidery frame 34, by the sewing needle 7 attached to the needle bar 6. During normal sewing of utility stitches that are not an embroidery pattern, the sewing is performed while the work cloth 30 is fed by the feed dog in a state in which the frame moving device 33 is removed from the bed portion 11.

Figure 3:
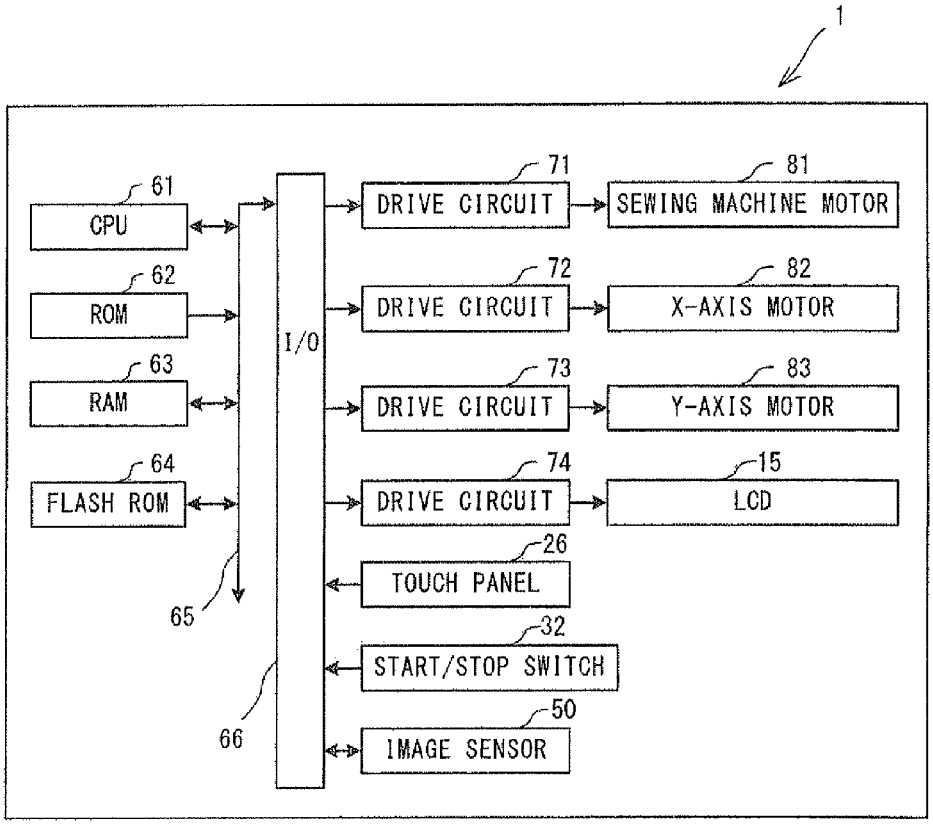
FIG. 3 is a block diagram showing an electrical configuration of the sewing machine.

An electrical configuration of the sewing machine 1 will be explained with reference to FIG. 3. As shown in FIG. 3, the sewing machine 1 includes a CPU 61, a ROM 62, a RAM 63, a flash ROM 64 and an input/output interface (I/O) 66. The ROM 62, the RAM 63, the flash ROM 64 and the input/output (I/O) interface 66 are each connected to the CPU 61 via a bus 65.

The CPU 61 is configured to perform main control of the sewing machine 1, and to perform various arithmetic calculations and processing relating to sewing in accordance with various programs stored in the ROM 62. Although not shown in the drawings, the ROM 62 has a plurality of storage areas that include a program storage area and a pattern storage area. Various programs for operating the sewing machine 1 may be stored in the program storage area. The stored programs may include, for example, a program that causes the sewing machine 1 to perform applique sewing processing that will be explained later. Sewing data for sewing various patterns may be stored in the pattern storage area. The various patterns may include, for example, utility stitches, embroidery patterns and applique patterns. The sewing data of the applique pattern (hereinafter referred to as applique data) that is used in the applique sewing processing of the present embodiment will be explained in detail later.

A storage area may be provided as necessary in the RAM 63. The storage area may store calculation results etc. of the arithmetic processing performed by the CPU 61. Various parameters etc. that are used for the sewing machine 1 to perform various processing may be stored in the flash ROM 64. Drive circuits 71 to 74, the touch panel 26, the start/stop switch 32 and the image sensor 50 are connected to the input/output (I/O) interface 66.

The sewing machine motor 81 is connected to the drive circuit 71. The drive circuit 71 may drive the sewing machine motor 81 in accordance with a control signal from the CPU 61. The needle bar up-and-down moving mechanism (not shown in the drawings) may be driven via the drive shaft (not shown in the drawings) of the sewing machine 1 in accordance with the driving of the sewing machine motor 81, and thus the needle bar 6 may be moved up and down. The X axis motor 82 is connected to the drive circuit 72. The Y axis motor 83 is connected to the drive circuit 73. The drive circuits 72 and 73 may respectively drive the X axis motor 82 and the Y axis motor 83 in accordance with a control signal from the CPU 61. The embroidery frame 34 may be moved in the left-right direction (the X axis direction) and in the front-rear direction (the Y axis direction), by a movement amount corresponding to the control signal, in accordance with the driving of the X axis motor 82 and the Y axis motor 83. The drive circuit 74 may drive the LCD 15 in accordance with a control signal from the CPU 61 and thus cause a screen to be displayed on the LCD 15.

Hereinafter, the applique data of the present embodiment will be explained. The applique data is data to be used to perform the applique sewing by the sewing machine 1. In the applique sewing, after a pattern of a selected shape is cut out from a first work cloth along a contour, the pattern is sewn onto a second work cloth that is different from the first work cloth. The applique data includes at least contour data and sewing-on data. The contour data is data to be used to form stitches that indicate a contour of a pattern (hereinafter referred to as contour stitches) on the first work cloth. The sewing-on data is data to be used to form stitches that attach, onto the second work cloth, the pattern cut out from the first work cloth along the contour stitches, namely along the contour of the pattern. Hereinafter, the pattern to be cut out along the contour is referred to as a cut out pattern.

The contour data and the sewing-on data each indicate at least positions of needle drop points and a sequence of the needle drop points. The needle drop point is a point at which the sewing needle 7 (refer to FIG. 2) that is positioned vertically above the needle hole pierces the work cloth 30 that is held by the embroidery frame 34. In the present embodiment, the position of the needle drop point is represented by coordinates of an XY coordinate system (hereinafter referred to as an embroidery coordinate system) that is used when the X axis motor 82 and the Y axis motor 83 move the embroidery frame 34. In other words, the contour data and the sewing-on data each include coordinate data of needle drop points.

In the embroidery coordinate system, the left-right direction of the sewing machine 1 is the X axis direction and the direction from the left to the right is the X axis plus direction. The front-rear direction of the sewing machine 1 is the Y axis direction, and the direction from the front to the rear is the Y axis plus direction. In the present embodiment, an initial position of the embroidery frame 34 is set to an origin point of the embroidery coordinate system. The initial position of the embroidery frame 34 is a position where the needle drop point coincides with a center point of a sewing area that is set automatically by the CPU 61 in accordance with the type of the embroidery frame 34. Then, the coordinate data of the needle drop points included in each of the contour data and the sewing-on data defines an initial layout of the applique pattern. The initial layout of the applique pattern is set such that a center point of the applique pattern coincides with the origin point of the embroidery coordinate system, namely with the center point of the sewing area.

In addition to the contour data and the sewing-on data, the applique data may also include at least one of internal pattern data and additional pattern data. The internal pattern data is data to be used to sew another pattern by embroidery inside the contour, before the contour stitches are sewn on the first work cloth. The additional pattern data is data to be used to sew yet another pattern by embroidery on the second work cloth, after the cut out pattern is sewn onto the second work cloth. Hereinafter, another pattern to be sewn inside the contour is referred to as an internal pattern. Another pattern to be sewn on the second work cloth after the cut out pattern is sewn onto the second work cloth is referred to as an additional pattern. Similarly to the contour data and the sewing-on data, each of the internal pattern data and the additional pattern data also includes at least data representing positions of needle drop points and a sequence of the needle drop points. Each of the contour data, the sewing-on data, the internal pattern data and the additional pattern data may further include data indicating a color of an embroidery thread (needle thread).

The applique data will be explained in more detail while taking as examples applique patterns 200 and 250 that are respectively shown in FIG. 4 and FIG. 5. The left-right direction and the up-down direction in FIG. 4 and FIG. 5 respectively correspond to the X axis direction and the Y axis direction of the embroidery coordinate system.

Figure 4:
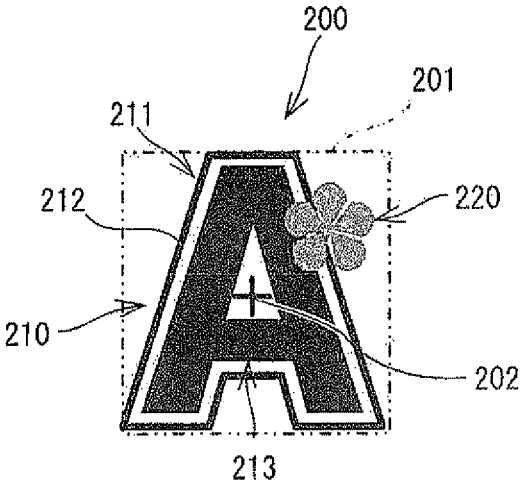
FIG. 4 is an explanatory diagram of an applique pattern.

The applique pattern 200 shown in FIG. 4 includes a pattern 210 that represents the capital letter "A" of the alphabet and a flower-shaped pattern 220 that partially overlaps with the upper right portion of the pattern 210. The pattern 210 further includes a pattern 211 that corresponds to a contour shape of the capital letter "A" of the alphabet and a pattern 213 that represents the capital letter "A" of the alphabet that is arranged inside a contour 212 of the pattern 211. The pattern 211, the pattern 213 and the pattern 220 are, the cut out pattern, the internal pattern and the additional pattern, respectively.

The applique data for the applique pattern 200 includes the following type of internal pattern data, contour data, sewing-on data and additional pattern data. First, the internal pattern data is data to be used to sew the pattern 213 on the first work cloth using satin stitches, for example. The contour data is data to be used to form the contour stitches in the first work cloth along the contour 212 of the pattern 211 using running stitches, for example. The sewing-on data is data to be used to sew the pattern 211 that has been cut out along the contour stitches onto the second work cloth along the contour 212, using zigzag stitches, for example. The sewing-on data may be, at the very least, data that enables the sewing machine 1 to form stitches that attaches the pattern 211 onto the second work cloth. The sewing-on data may further include, for example, data of satin stitches that cover the zigzag stitches. The additional pattern data is data to be used to sew the pattern 220 using satin stitches, for example, on top of the pattern 210 that is sewn on the second work cloth.

All of the coordinate data in these pieces of data are set such that a center point 202 of the applique pattern 200 (more specifically, of a minimum rectangle 201 that encloses the applique pattern 200) coincides with the origin point of the embroidery coordinate system.

Figure 5:
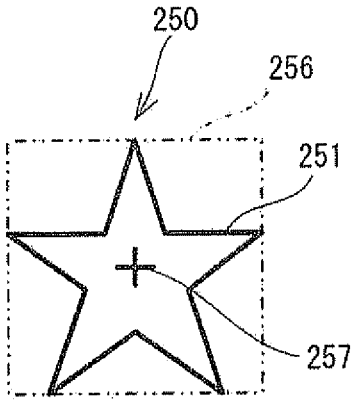
FIG. 5 is an explanatory diagram of another applique pattern.

The applique pattern 250 shown in FIG. 5 is formed only of a star-shaped pattern that is a cut out pattern, and does not include an internal pattern and an additional pattern. Thus, the applique data for the applique pattern 250 only includes the contour data and the sewing-on data that are similar to the applique pattern 200 explained above. All the coordinate data in these pieces of data are set such that a center point 257 of the applique pattern 250 (more specifically, of a minimum rectangle 256 that encloses the applique pattern 250) coincides with the origin point of the embroidery coordinate system. As described in the two examples above, the data for the cut out pattern that includes the internal pattern includes the contour data and the internal pattern data, and the data for the cut out pattern that does not include the internal pattern only includes the contour data.

The applique sewing processing according to the present embodiment will be explained with reference to FIG. 6 to FIG. 11. The applique sewing processing is started when a user inputs a command to start the applique sewing processing by a panel operation, for example. When the CPU 61 detects the input of the command to start the applique sewing processing, the CPU 61 reads out, to the RAM 63, the program stored in the ROM 62 for performing the applique sewing processing (refer to FIG. 3), and performs processing of each of the steps described below in accordance with instructions included in the program. Before causing the sewing machine 1 to start the applique sewing processing, the user sets the first work cloth, on which the cut out pattern will be formed, in the embroidery frame 34.

Figure 6:
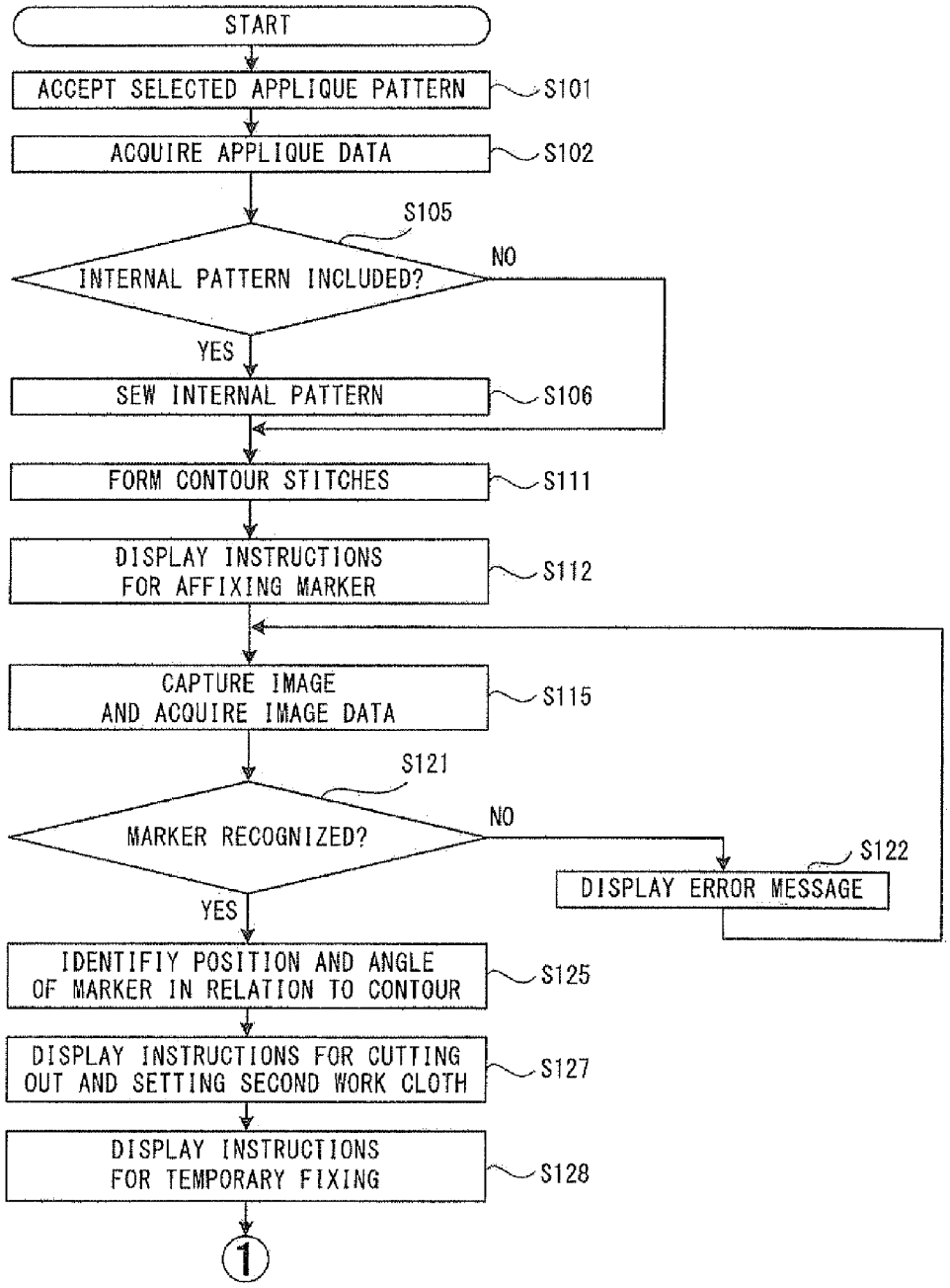
FIG. 6 is a flowchart of applique sewing processing.
Figure 7:
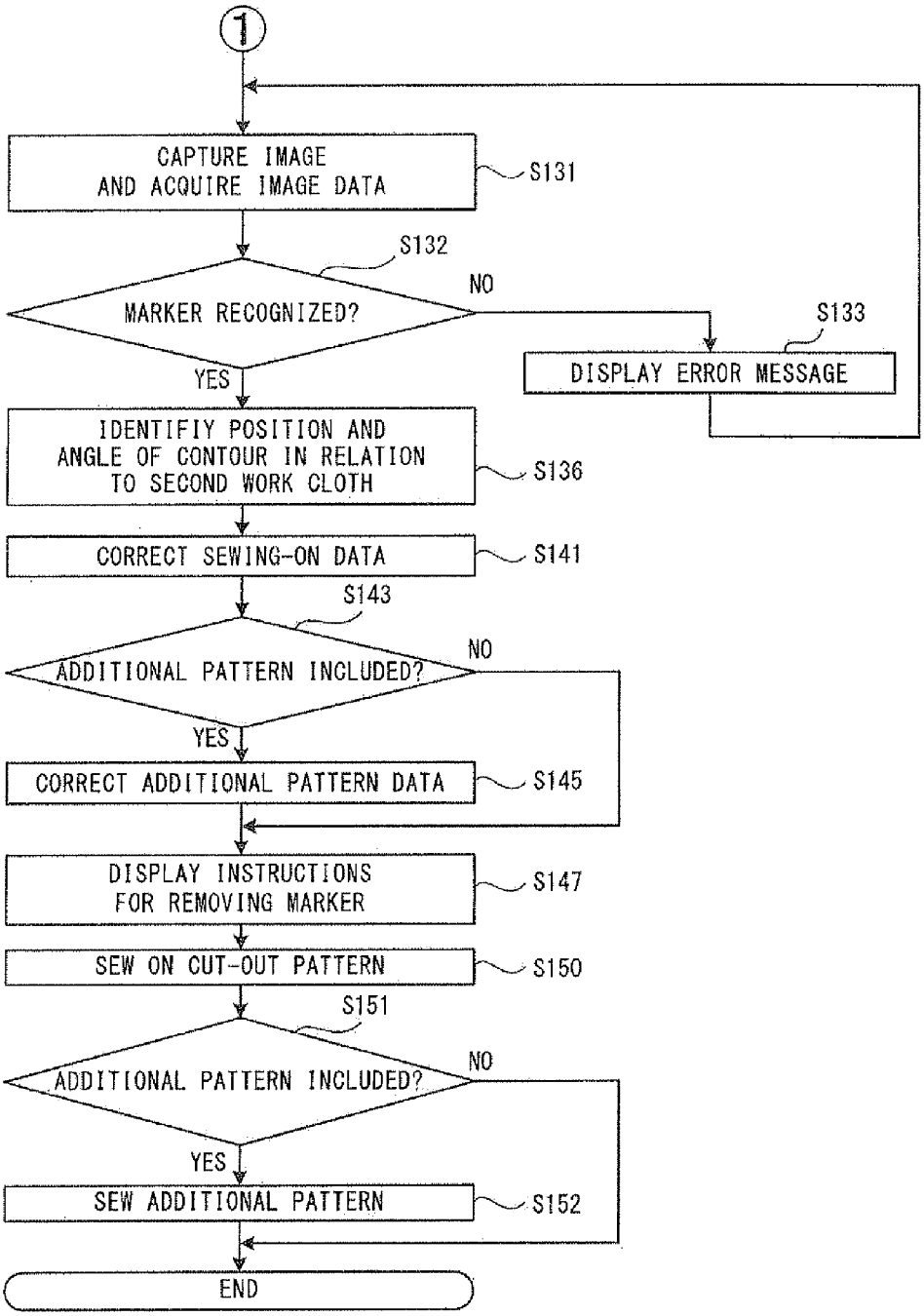
FIG. 7 is a flowchart of the applique sewing processing and is a continuation of FIG. 6.

As shown in FIG. 6, in the applique sewing processing, the CPU 61 first accepts selection of the applique pattern that is a sewing target (step S101). Specifically, for example, the CPU 61 causes a screen to be displayed on the LCD 15 (refer to FIG. 1), the screen showing a plurality of applique patterns for which applique data is stored in the ROM 62. When the user selects one of the displayed applique patterns by a panel operation, the selected applique pattern (hereinafter referred to as a selected pattern) is identified as the sewing target.

Figure 8:
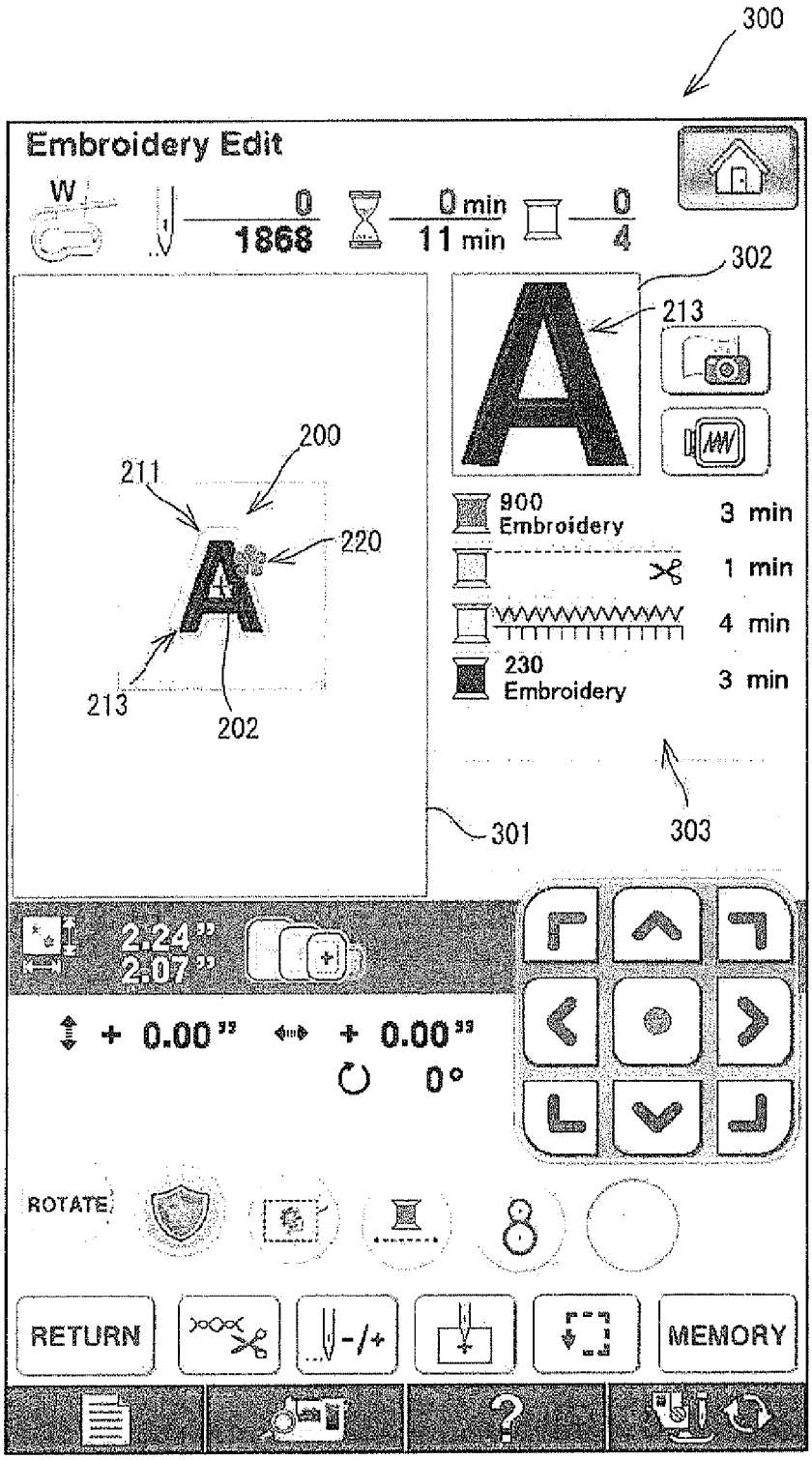
FIG. 8 is an explanatory diagram of a screen displayed on a liquid crystal display.

The CPU 61 acquires the applique data of the selected pattern from the ROM 62 and stores the applique data in the RAM 63 (step S102). At this time, the CPU 61 causes a screen 300 (refer to FIG. 8), which shows information relating to the sewing of the selected pattern, to be displayed on the LCD 15. FIG. 8 shows an example of the screen 300 in a case where the applique pattern 200 is the selected pattern. The screen 300 includes a selected pattern section 301 that displays a sewing result of the selected pattern, a next pattern section 302 that displays the pattern to be sewn next, a thread information section 303 that shows information relating to threads necessary to sew the selected pattern, and various keys to be used to execute various functions.

The selected pattern section 301 corresponds to a sewing area that has been set in correspondence to the embroidery frame 34 mounted on the frame moving device 33. The left-right direction and the up-down direction of the selected pattern section 301 respectively indicate the X axis direction and the Y axis direction of the embroidery coordinate system. Thus, the sewing result of the selected pattern is displayed such that the center point of the sewing result (the center point 202 of the applique pattern 200 in the example shown in FIG. 8) coincides with the center point of the selected pattern section 301. In the example shown in FIG. 8, the sewing of the applique pattern 200 has not yet been performed, and thus the pattern 213 that is the internal pattern that will be sewn first is displayed in the next pattern section 302. Information relating to a thread to be used to sew the internal pattern (the pattern 213), to a thread to be used for the contour stitches of the cut out pattern (the pattern 211), to a thread to be used to sew on the cut out pattern (the pattern 211) and to a thread to be used to sew the additional pattern (the pattern 220) is displayed, in this order from the top, in the thread information section 303.

After that, when the user presses the start/stop switch 32 (refer to FIG. 1) and thereby inputs the command to start the sewing, based on whether or not the applique data acquired at step S102 includes the internal pattern data, the CPU 61 determines whether or not the selected pattern includes the internal pattern (step S105). For example, in a case where the internal pattern is included, as in the case of the pattern 213 of the applique pattern 200 shown in FIG. 4 (yes at step S105), the CPU 61 performs processing to sew the internal pattern (step S106). More specifically, the CPU 61 drives the X axis motor 82 and the Y axis motor 83 (refer to FIG. 3) in accordance with the internal pattern data, and thus moves the embroidery frame 34 using the frame moving device 33. The CPU 61 drives the sewing machine motor 81 at the same time as moving the embroidery frame 34, and causes the needle bar 6, to which the sewing needle 7 is attached, to move up and down, thus sewing the internal pattern on the first work cloth held by the embroidery frame 34. When the sewing of the internal pattern is complete, the CPU 61 advances the processing to step S111.

On the other hand, in a case where the internal pattern is not included in the selected pattern, as in the case of the applique pattern 250 shown in FIG. 5, for example (no at step S105), the CPU 61 directly advances the processing to step S111. At step S111, the CPU 61 controls the sewing machine motor 81, the X axis motor 82 and the Y axis motor 83 in accordance with the contour data included in the applique data and performs processing to form the contour stitches along the contour of the pattern (step S111). In the example of the applique pattern 200, the contour stitches are formed along the contour 212 of the pattern 211. In the example of the applique pattern 250, the contour stitches are formed along a contour 251 of the applique pattern 250.

Figure 9:
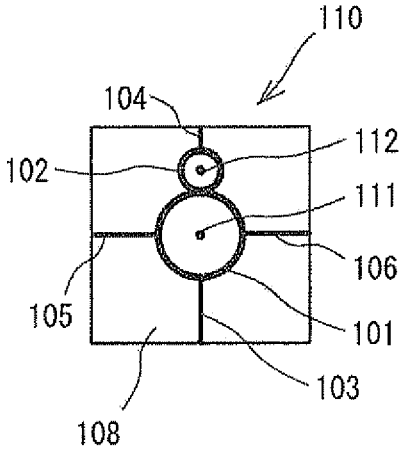
FIG. 9 is an explanatory diagram of a marker.

When the forming of the contour stitches is complete, the CPU 61 causes a screen (not shown in the drawings) to be displayed on the LCD 15 (step S112), the screen including a message that instructs the user to affix a marker 110 such as that exemplified in FIG. 9 inside the contour stitches formed on the first work cloth. The marker 110 employed in the present embodiment is used to identify the layout of the cut out pattern, using image recognition processing.

The marker 110 will be explained with reference to FIG. 9. The marker 110 includes a white thin plate-shaped sheet 108 and a line drawing drawn in black on the upper surface of the sheet 108. The sheet 108 is, for example, a square shape with a length of 2.5 cm and a width of 2.5 cm. The line drawing drawn on the upper surface of the sheet 108 includes a first circle 101, a first center point 111 that is the center of the first circle 101, a second circle 102, a second center point 112 that is the center of the second circle 102 and line segments 103, 104, 105 and 106.

The first circle 101 is drawn such that the first center point 111 is the center point of the square shaped sheet 108. The second circle 102 is in contact with the first circle 101 and is drawn in a position such that a virtual line (not shown in the drawings) that passes through the first center point 111 and the second center point 112 is parallel to a side of the sheet 108. The diameter of the second circle 102 is smaller than the diameter of the first circle 101. The line segment 103 and the line segment 104 are line segments that overlap with the virtual line (not shown in the drawings) that passes through the first center point 111 and the second center point 112 and that extend, respectively, from the first circle 101 and the second circle 102 to the outer edge of the sheet 108. The line segment 105 and the line segment 106 are line segments that overlap with a virtual line (not shown in the drawings) that passes through the first center point 111 of the first circle 101 and that is perpendicular to the line segment 103. The line segment 105 and the line segment 106 extend, respectively, from the outer edge of the first circle 101 to the outer edge of the sheet 108.

The user affixes the marker 110 on the inside of the contour stitches on the first work cloth in accordance with the instructions. After that, the user selects, by a panel operation, an OK button that is displayed on the screen on the LCD 15 along with the above-described message. When the OK button is selected, as shown in FIG. 6, the CPU 61 controls the image sensor 50 in a state in which the embroidery frame 34 is in the initial position and causes the image sensor 50 to perform image capture, and latest image data output from the image sensor 50 is acquired into a predetermined storage area of the RAM 63 (step S115). In the present embodiment, the image capture range of the image sensor 50 is a rectangular area that has the needle hole at the center and that is longer in the Y axis direction (the front-rear direction of the sewing machine 1).

Figure 10:
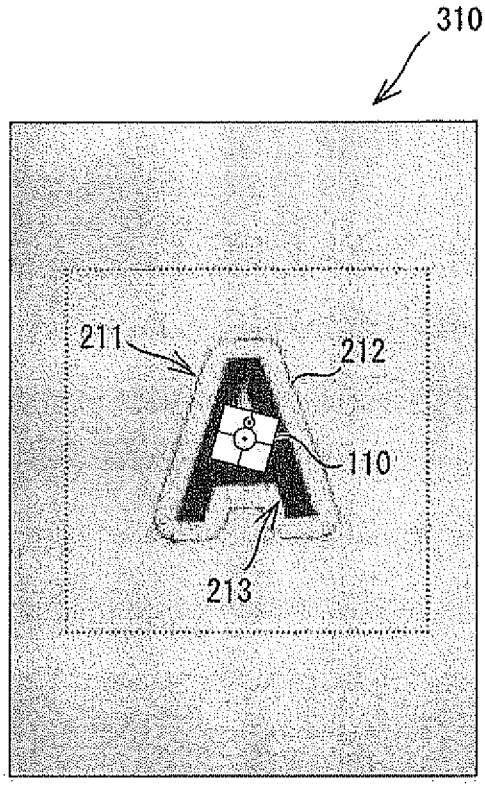
FIG. 10 is an explanatory diagram of a screen that displays a captured image.

At step S115, as shown in FIG. 10, the CPU 61 causes a screen 310, which includes an image (hereinafter referred to as a captured image) that is represented by the acquired latest image data, to be displayed on the LCD 15. The screen 310 corresponds to the image capture range of the image sensor 50 and the center of the screen 310 is the center of the image capture range. In the processing preceding step S115, as described above, the internal pattern (in a case where there is the internal pattern) and the contour stitches have already been formed. Thus, as shown in FIG. 10, in a case where the selected pattern is the applique pattern 200 shown in FIG. 4, the screen 310 is displayed that includes, in a central portion thereof, the pattern 213 of the alphabet character "A" that has been sewn by embroidery, the contour stitches that have been formed along the contour 212 of the pattern 211 and the marker 110 that has been affixed inside the contour stitches.

As shown in FIG. 6, after the image data has been acquired, the CPU 61 determines whether or not it is possible to recognize the marker 110 in the captured image (step S121). The recognition of the marker 110 may be performed using any known image recognition method. For example, edge extraction, and pattern matching using a template indicating contour lines of the first circle 101 and the second circle 102 and the line segments 103 to 106 may be performed. In a case where the CPU 61 cannot recognize the marker 110 (no at step S121), there is a high possibility that the marker 110 has not been affixed in a suitable position and is not included within the image capture range. Thus, the CPU 61 causes a screen (not shown in the drawings) to be displayed on the LCD 15, the screen including notification of an error occurrence and a message prompting the user to re-affix the marker 110 inside the contour stitches (step S122). The CPU 61 then returns the processing to step S115.

In a case where the CPU 61 can recognize the marker 110 (yes at step S121), the CPU 61 identifies the position and the angle of the marker 110 in relation to the contour stitches, based on the contour data acquired at step S102 and the latest image data acquired at step S115 (step S125). Hereinafter, "the position and the angle" will simply be referred to as a "layout." The image capture range of the image sensor 50 is fixed and therefore, a relationship is fixed between a position of a point in the captured image when the embroidery frame 34 is in the initial position and coordinates of the position in the embroidery coordinate system. Accordingly, for example, the CPU 61 can identify the coordinates, in the embroidery coordinate system, of the first center point 111 and the second center point 112 of the marker 110 that is recognized at step S121. The CPU 61 then identifies the layout of the marker 110 in relation to the contour stitches by associating the coordinates of the first center point 111 and the second center point 112 with the coordinate data of the contour stitches.

The CPU 61 causes a screen (not shown in the drawings) to be displayed on the LCD 15, the screen including a message instructing the user to remove the first work cloth from the embroidery frame 34, to cut out the cut out pattern from the first work cloth along the contour stitches and to set the second work cloth in the embroidery frame 34 (step S127). In accordance with the instructions, the user cuts out the cut out pattern and sets the second work cloth in the embroidery frame 34. After that, the user selects, by a panel operation, an OK button that is displayed along with the above-described message on the screen of the LCD 15.

When the OK button is selected, the CPU 61 causes a screen (not shown in the drawings) to be displayed on the LCD 15, the screen including a message instructing the user to temporarily fix the cut out pattern in a desired position on the second work cloth that is held by the embroidery frame 34 (step S128). In accordance with the instructions, the user temporarily fixes the cut out pattern using adhesive, for example, to the second work cloth. The user then selects, by a panel operation, an OK button that is displayed along with the above-described message on the screen of the LCD 15.

Figure 11:
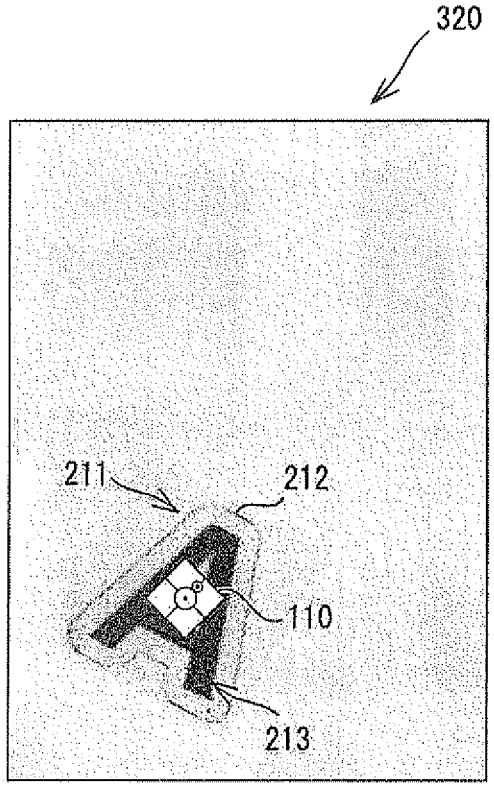
FIG. 11 is an explanatory diagram of a screen that displays another captured image.

When the OK button is selected, the CPU 61 controls the image sensor 50 in a state in which the embroidery frame 34 is in the initial position and causes the image sensor 50 to perform image capture. The CPU 61 acquires the latest image data output from the image sensor 50 (step S131 shown in FIG. 7). Further, as shown in FIG. 11, the CPU 61 causes a screen 320, which includes a latest captured image, to be displayed on the LCD 15. In the example shown in FIG. 11, the cut out pattern 211 is temporarily fixed in a position that is misaligned with the center of the image capture range.

In a case where the CPU 61 cannot recognize the marker 110 in the captured image (no at step S132), similarly to the above-described processing at step S122, the CPU 61 causes a screen to be displayed on the LCD 15, the screen notifying an error occurrence (step S133). The CPU 61 then returns the processing to step S131. In a case where the CPU 61 can recognize the marker 110 (yes at step S132), the CPU 61 identifies the layout of the contour of the cut out pattern in relation to the second work cloth, based on the contour data acquired at step S102 and on the layout of the marker 110 in relation to the contour stitches identified at the above-described step S125 (step S136). First, from the positions in the captured image of the first center point 111 and the second center point 112 of the marker 110 recognized at step S132, the CPU 61 identifies the coordinates of the first center point 111 and the second center point 112. The CPU 61 identifies the layout of the contour of the cut out pattern in relation to the second work cloth by converting the coordinates of the needle drop points represented by the contour data, based on the layout of the marker 110 in relation to the contour stitches identified at step S125.

In addition, the CPU 61 corrects the sewing-on data based on the layout of the contour of the cut out pattern in relation to the second work cloth (step S141). More specifically, the CPU 61 corrects the sewing-on data by converting the coordinate data of the needle drop points included in the sewing-on data acquired at the above-described step S102 in accordance with a conversion relationship of the needle drop points of the contour stitches identified at step S136.

The CPU 61 determines whether or not the additional pattern is included in the selected pattern (step S143). In a case where the additional pattern is included (yes at step S143), the CPU 61 corrects the additional pattern data acquired at step S102 (step S145). The method of correcting the additional pattern data is the same as the above-described method used to correct the sewing-on data at step S141. The CPU 61 advances the processing to step S147. In a case where the additional pattern is not included in the selected pattern (no at step S143), the CPU 61 directly advances the processing to step S147.

The CPU 61 causes a screen (not shown in the drawings) to be displayed on the LCD 15. The screen includes a message instructing the user to remove the marker 110 from the second work cloth (step S147), so that the sewing needle 7 will not pierce the marker 110 when sewing on the cut out pattern and sewing the additional pattern.

After the user has removed the marker 110 from the second work cloth in accordance with the instructions, the user inputs the command to start sewing by depressing the start/stop switch 32. When the instruction to start the sewing is input, the CPU 61 controls the sewing machine motor 81, the X axis motor 82 and the Y axis motor 83 in accordance with the sewing-on data corrected at step S141, and performs processing to sew the cut out pattern onto the second work cloth (step S150). In the example of the applique pattern 200, after the pattern 211 has been sewn onto the second work cloth using zigzag stitches along the contour 212 of the pattern 211, satin stitches are formed to cover the zigzag stitches.

In addition, in a case where the additional pattern is included in the selected pattern (yes at step S151), the CPU 61 controls the sewing machine motor 81, the X axis motor 82 and the Y axis motor 83 in accordance with the additional pattern data corrected at step S145, and performs processing to sew the additional pattern (step S152). In the example of the applique pattern 200 shown in FIG. 4, the flower pattern 220 is sewn by embroidery such that the pattern 220 partially overlaps with the pattern 211. When the sewing of the additional pattern is complete, the CPU 61 ends the applique sewing processing. In a case where the additional pattern is not included in the selected pattern (no at step S151), the CPU 61 ends the applique sewing processing.

As explained above, the sewing machine 1 of the present embodiment identifies the position of the marker 110 in the captured image including the marker 110 that is affixed to the first work cloth held by the embroidery frame 34. The sewing machine 1 also identifies the position of the marker 110 in the captured image of the cut out pattern that has been cut out from the first work cloth in a state in which the marker 110 is affixed and that is temporarily fixed onto the second work cloth. The sewing machine 1 can identify the position and the angle of the contour of the cut out pattern that is temporarily fixed to the second work cloth based on the identified positions of the marker 110. Based on the identified position and angle of the contour of the pattern in relation to the second work cloth, the sewing machine 1 can correct the sewing-on data to be used to form the stitches to sew the cut out pattern onto the second work cloth. As a result, even when the user temporarily fixes the cut out pattern cut out from the first work cloth onto the second work cloth at a desired position and angle, the sewing machine 1 can accurately sew the cut out pattern onto the second work cloth.

Further, with the sewing machine 1, it is not necessary to form guide stitches in the second work cloth that indicate the position and angle at which the cut out pattern should be temporarily fixed, which is necessary in known methods. In known methods, when the guide stitches are once formed in the second work cloth, after that, it is not possible to change the position and angle at which the cut out pattern is arranged in relation to the second work cloth. Therefore, in known methods, it is necessary for the user to perform accurate positioning when setting the second work cloth in the embroidery frame 34. On the other hand, according to the applique sewing processing of the present embodiment, after setting the second work cloth in the embroidery frame 34, the user can temporarily fix the cut out pattern easily at a desired position and angle, considering the pattern etc. of the second work cloth.

Further, in a case where there is the additional pattern to be sewn on the second work cloth after the cut out pattern is sewn onto the second work cloth, the additional pattern data to be used to sew the additional pattern can also be corrected, based on the position and angle of the contour of the cut out pattern in relation to the second work cloth. Thus, even when the user temporarily fixes the cut out pattern cut out from the first work cloth onto the second work cloth at a desired position and angle, it is possible to sew the additional pattern in an accurate position in relation to the cut out pattern.

The above-described embodiment explains an example in which the layout of the contour of the cut out pattern in relation to the second work cloth is identified using the marker 110. However, other methods, which will be explained below, may be used to identify the layout of the contour of the cut out pattern in relation to the second work cloth.

Another embodiment will be explained with reference to FIG. 12 and FIG. 13. In the present embodiment, the layout of the contour of the cut out pattern in relation to the second work cloth is identified using at least two feature points that are inside the contour stitches on the first work cloth. Note that most of the configuration of the sewing machine 1 and most of the content of the applique sewing processing is the same as in the above-described embodiment using the marker 110. Thus, in a flowchart shown in FIG. 12, the same step numbers are assigned to steps in the processing that are the same as those shown in the flowchart in FIG. 6 and FIG. 7. Hereinafter, an explanation will be mainly made of content of processing that is different to that of the above-described embodiment.

Figure 12:
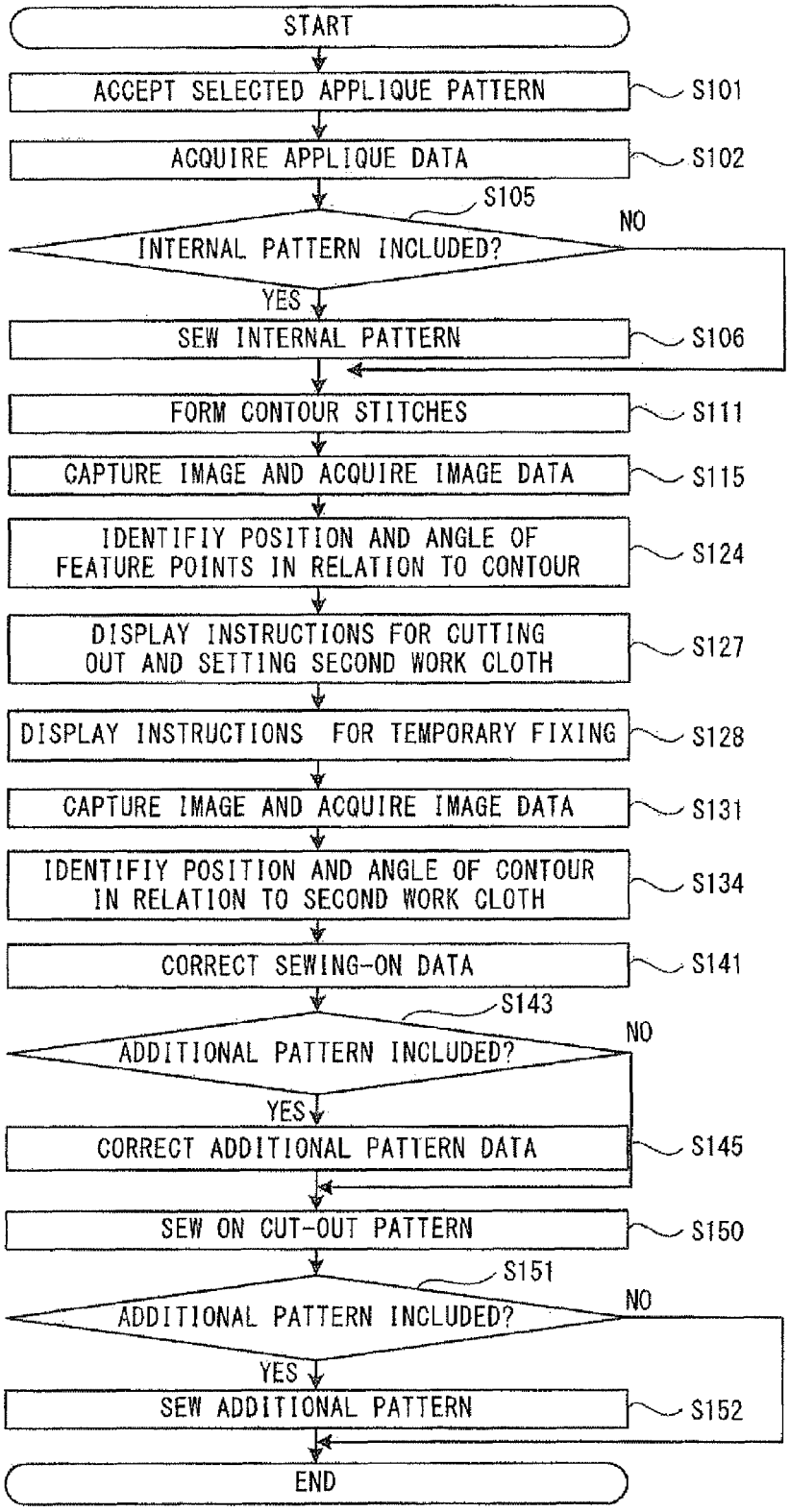
FIG. 12 is a flowchart of applique sewing processing according to another embodiment.
Figure 13:
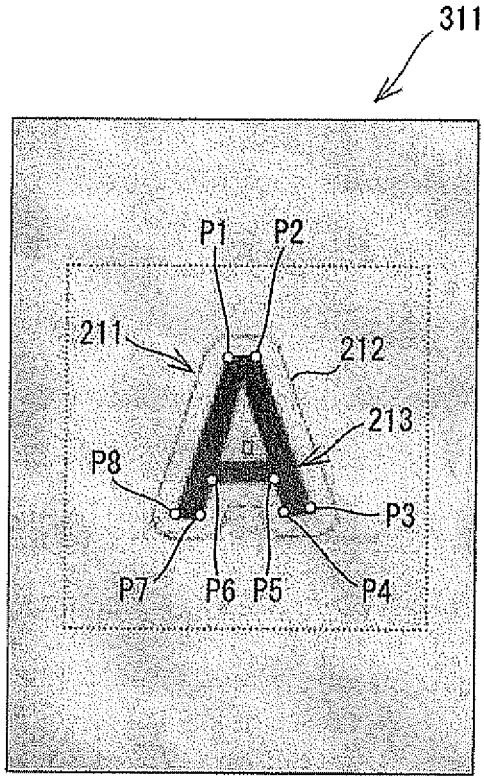
FIG. 13 is an explanatory diagram of feature points that are extracted from a captured image.

As shown in FIG. 12, the content of the processing from when the applique pattern is selected up to when the contour stitches are formed (step S101 to step S111) is the same as the processing of the above-described embodiment. In the present embodiment, after the contour stitches are formed at step S111, the marker 110 is not affixed to the first work cloth. The CPU 61 causes the image sensor 50 to perform image capture and acquires image data of an image inside the contour stitches (step S115). Based on the contour data acquired at step S102 and on the latest image data acquired at step S115, the CPU 61 identifies a position and an angle of at least two feature points, which are located inside the contour stitches, in relation to the contour stitches (step S124).

More specifically, the CPU 61 first extracts the at least two feature points that are inside the contour stitches in the captured image, based on the acquired image data. The extraction of the feature points may be performed using any known image recognition method. In a case where the applique pattern 200 shown in FIG. 4 is the pattern selected at step S101, the pattern 213 that is the internal pattern sewn by embroidery and the contour stitches formed along the contour 212 of the pattern 211 are included in the captured image, as shown in FIG. 13. The CPU 61 can extract eight corners indicated by points P1 to P8 as the feature points, for example. The eight corners correspond to edges of the contour of the pattern 213. In a case where the internal pattern is not sewn inside the contour stitches, the CPU 61 may extract the feature points based on a pattern etc. of the first work cloth itself inside the contour stitches. Further, in the present embodiment, the number of the feature points is not particularly limited as long as there are at least two feature points. The CPU 61 identifies coordinates of the extracted feature points in the embroidery coordinate system, and identifies the layout of the feature points in relation to the contour stitches by associating the identified coordinates with the coordinate data of the contour stitches.

Next, in accordance with instructions displayed on the LCD 15, the user cuts out the cut out pattern from the first work cloth and sets the second work cloth in the embroidery frame 34. After the cut out pattern is temporarily fixed onto the second work cloth by the user, the CPU 61 acquires the latest image data (step S127 to step S131). The CPU 61 identifies the layout of the contour of the cut out pattern in relation to the second work cloth (step S134) based on the acquired image data and on the layout of the feature points in relation to the contour stitches identified at step S124.

Based on the acquired image data, the CPU 61 first extracts at least two feature points from the captured image, using the same method as that used at step S124, and identifies the coordinates of the feature points. For example, in a case where the eight corners of the points P1 to P8 are extracted at step S124, at step S134 the CPU 61 also extracts eight corners corresponding to the points P1 to P8. Then, based on the layout of the at least two features points in relation to the contour stitches that has been identified at step S124, the CPU 61 identifies the layout of the contour of the cut out pattern in relation to the second work cloth by converting the coordinates of the needle drop points indicated by the contour data.

After that, the CPU 61 corrects the sewing-on data (step S141) based on the layout of the contour of the cut out pattern in relation to the second work cloth that has been identified at step S134. In a case where there is the additional pattern, the CPU 61 also corrects the additional pattern data (step S143 to step S145). Following that, the CPU 61 sews the cut out pattern onto the second work cloth in accordance with the corrected sewing-on data (step S150). In a case where there is the additional pattern, the CPU 61 sews the additional pattern in accordance with the corrected additional pattern data (step S151 to step S152) and ends the applique sewing processing. The content of the processing from step S141 to step S152 is the same as that of the previously described embodiment.

As described above, the sewing machine 1 of the present embodiment extracts the at least two feature points that are inside the contour stitches from the captured image of the inside of the contour stitches formed in the first work cloth held by the embroidery frame 34. The sewing machine 1 also extracts the at least two feature points from the captured image of the cut out pattern that has been cut out from the first work cloth and that is temporarily fixed onto the second work cloth. Based on the positions of the extracted feature points, the sewing machine 1 can identify the position and angle of the contour of the cut out pattern that is temporarily fixed to the second work cloth. Based on the identified position and angle of the contour of the cut out pattern in relation to the second work cloth, the sewing machine 1 can correct the sewing-on data to be used to form the stitches to sew the cut out pattern onto the second work cloth. As a result, even when the user temporarily fixes the cut out pattern that is cut out from the first work cloth onto the second work cloth at a desired position and angle, it is possible to accurately sew the cut out pattern onto the second work cloth. Therefore, with the sewing machine 1, it is not necessary to form the guide stitches in the second work cloth that indicate the position and angle at which the cut out pattern should be temporarily fixed.

Yet another embodiment will be explained with reference to FIG. 14. In the present embodiment, the layout of the contour of the cut out pattern in relation to the second work cloth or a layout of an internal pattern in relation to the second work cloth is identified. Note that most of the configuration of the sewing machine 1 and most of the content of the applique sewing processing is the same as in the above-described embodiment using the marker 110. Thus, in a flowchart shown in FIG. 14, the same step numbers are assigned to steps in the processing that are the same as those shown in the flowchart in FIG. 6 and FIG. 7. Hereinafter, an explanation will be mainly made of content of processing that is different to that of the above-described embodiment.

Figure 14:
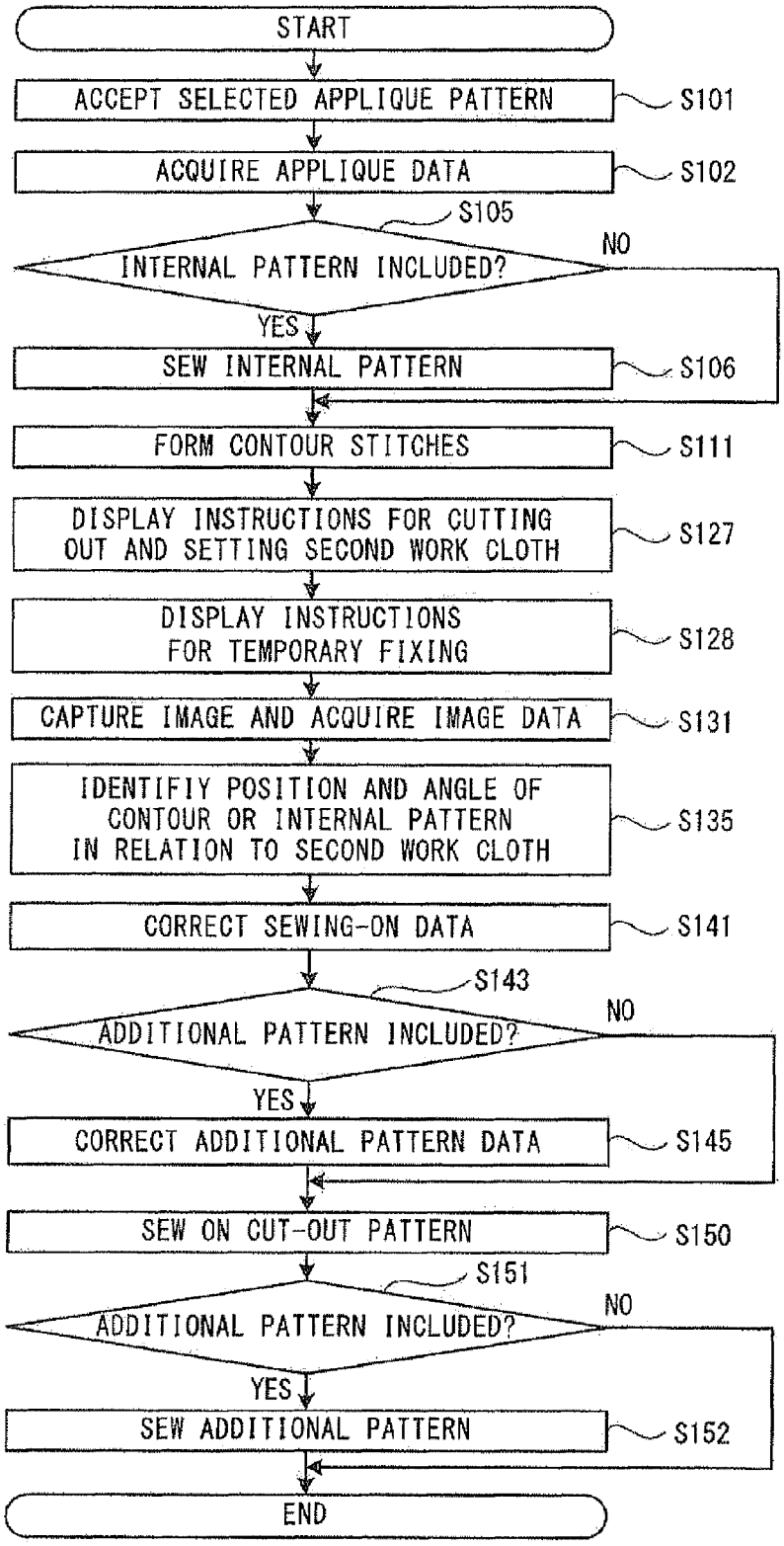
FIG. 14 is a flowchart of applique sewing processing according to yet another embodiment.

As shown in FIG. 14, the content of the processing from when the applique pattern is selected up to when the contour stitches are formed (step S101 to step S111) is the same as the processing of the above-described embodiment. In the present embodiment, after the contour stitches are formed at step S111, image capture of the first work cloth is not performed. After step S111, in accordance with instructions displayed on the LCD 15, the user cuts out the cut out pattern from the first work cloth and sets the second work cloth in the embroidery frame 34. After the cut out pattern is temporarily fixed to the second work cloth by the user, the CPU 61 acquires the latest image data (step S127 to step S131). The CPU 61 identifies the layout of the contour of the cut out pattern or the layout of the internal pattern in relation to the second work cloth (step S135) based on the acquired image data and based on the contour data or the internal pattern data acquired at step S102.

More specifically, at step S135, the CPU 61 identifies the contour of the cut out pattern or identifies the internal pattern, depending on whether or not the applique data acquired at step S102 includes the internal pattern data. In a case where the applique data does not include the internal pattern data, the CPU 61 identifies the layout of the contour of the cut out pattern in relation to the second work cloth based on the contour data. Based on the coordinate data included in the contour data, the CPU 61 first identifies the contour of the cut out pattern. The CPU 61 then extracts feature points in the captured image represented by the acquired image data, and identifies the contour of the cut out pattern in the captured image by performing pattern matching with the contour of the cut out pattern. The extraction of the feature points may be performed using any known image recognition method. The CPU 61 identifies coordinates, in the embroidery coordinate system, of needle drop points on the contour identified in the captured image. The layout of the contour of the cut out pattern in relation to the second work cloth is identified in this manner.

In a case where the internal pattern data is included in the applique data, the CPU 61 may identify the layout of the contour of the cut out pattern in relation to the second work cloth based on the contour data, as described above, or may identify the layout of the internal pattern in relation to the second work cloth based on the internal pattern data, as described below. Based on coordinate data of needle drop points included in the internal pattern data, the CPU 61 first identifies a shape of the internal pattern. The CPU 61 extracts feature points in the captured image represented by the acquired image data, and identifies the internal pattern in the captured image by performing pattern matching with the shape of the internal pattern. The extraction of the feature points may be performed using any known image recognition method. By identifying coordinates, in the embroidery coordinate system, of the needle drop points of the internal pattern identified in the captured image, the CPU 61 identifies the layout of the internal pattern in relation to the second work cloth.

After that, the CPU 61 corrects the sewing-on data (step S141) based on the layout of the contour of the cut out pattern in relation to the second work cloth or on the layout of the internal pattern in relation to the second work cloth that has been identified at step S135. In a case where there is the additional pattern, the CPU 61 also corrects the additional pattern data (step S143 to step S145). Following that, the CPU 61 sews the cut out pattern onto the second work cloth in accordance with the corrected sewing-on data (step S150). In a case where there is the additional pattern, the CPU 61 sews the additional pattern in accordance with the corrected additional pattern data (step S151 to step S152) and ends the applique sewing processing. The content of the processing from step S141 to step S152 is the same as that of the previously described embodiment.

A cut out line may be slightly displaced from the contour stitches when the user actually cuts out the cut out pattern from the first work cloth. In the present embodiment, the contour of the cut out pattern that is identified by the feature points extracted at step S135 using image recognition processing corresponds to an actual cut out line. Thus, based on data representing the identified actual cut out line and on the contour data, the CPU 61 may correct the contour data depending on an amount of displacement occurring when the cut out pattern is cut out. In a case where the additional pattern data is included in the applique data, the additional pattern data may also be similarly corrected.

As described above, based on the contour data and on the captured image of the cut out pattern that is cut out from the first work cloth and that is temporarily fixed onto the second work cloth, the sewing machine 1 of the present embodiment can identify the position and angle of the contour of the cut out pattern that is temporarily fixed to the second work cloth. Based on the identified position and angle of the contour of the cut out pattern in relation to the second work cloth, the sewing machine 1 can correct the sewing-on data to be used to form stitches to sew the cut out pattern onto the second work cloth. Thus, even when the user temporarily fixes the cut out pattern that is cut out from the first work cloth onto the second work cloth at a desired position and angle, the sewing machine 1 can accurately sew the cut out pattern onto the second work cloth. As a result, it is not necessary for the sewing machine 1 to form the guide stitches in the second work cloth that indicate the position and angle at which the cut out pattern should be temporarily fixed.

The present disclosure is not limited to the above-described embodiments, and various other modifications are possible. For example, in addition to the sewing machine 1 that has the single needle bar 6, a multi-needle sewing machine that has a plurality of needle bars may be used as the sewing machine that performs the applique sewing processing.

In the above-described embodiments, the example is given in which the sewing data for the applique patterns are stored in the ROM 62. However, the sewing data may be stored in another storage device, such as the flash ROM 64, of the sewing machine 1. Further, in a case where the sewing machine 1 is configured to be connectable to a medium such as a memory card, the sewing machine 1 may acquire sewing data that is stored in the medium, and may store the acquired sewing data in a storage device, such as the flash ROM 64, of the sewing machine 1. In a case where the sewing machine 1 is configured to be connectable to an external device, via a wired connection or a wireless connection, the sewing machine 1 may acquire sewing data that is stored in the external device and may store the acquired sewing data in the storage device.

A type and a position of the image sensor 50 may be changed as appropriate. For example, the image sensor 50 may be a device that is capable of capturing an image and outputting image data thereof, such as a CCD camera. Further, in a case where the image capture range of the image sensor 50 is smaller than the sewing area of the embroidery frame 34, the whole sewing area may be divided into a plurality of blocks and processing to recognize the marker 110 or the cut out pattern may be performed while causing the embroidery frame 34 to move, in sequence, to a position corresponding to each of the blocks.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an imaging device configured to capture an image;

a processor; and a memory configured to store:

sewing data that includes at least first stitch data and second stitch data, the first stitch data being data to be used to form first stitches on a first work cloth, the first stitches being stitches that indicate a contour of a pattern, the second stitch data being data to be used to form second stitches, the second stitches being stitches that attach the pattern cut out from the first work cloth along the first stitches onto a second work cloth; and computer-readable instructions that, when executed by the processor, cause the processor to perform processes comprising:

causing the imaging device to capture a first image, the first image being an image including a marker affixed inside the first stitches formed on the first work cloth based on the first stitch data;

identifying, based on the first stitch data and on first image data, a position and an angle of the marker in relation to the contour, the first image data being image data of the first image;

causing the imaging device to capture a second image, the second image being an image including the marker affixed to the pattern, the pattern having been cut out from the first work cloth and being temporarily fixed at a desired position and angle on the second work cloth, the pattern having been cut out along the first stitches in a state in which the marker is affixed;

identifying, based on second image data and on the identified position and angle of the marker in relation to the contour, a position and an angle of the contour in relation to the second work cloth, the second image data being image data of the second image; and correcting the second stitch data in accordance with the identified position and angle of the contour in relation to the second work cloth.

2. The sewing machine according to claim 1, wherein the sewing data further includes third stitch data, the third stitch data being data representing stitches of an additional pattern to be sewn by embroidery after the pattern is sewn onto the second work cloth, and the computer-readable instructions further cause the processor to perform a process of correcting the third stitch data in accordance with the identified position and angle of the contour in relation to the second work cloth.

3. A sewing machine comprising:

an imaging device configured to capture an image;

a processor; and a memory configured to store:

sewing data that includes at least first stitch data and second stitch data, the first stitch data being data to be used to form first stitches on a first work cloth, the first stitches being stitches that indicate a contour of a pattern, the second stitch data being data to be used to form second stitches, the second stitches being stitches that attach the pattern cut out from the first work cloth along the first stitches onto a second work cloth; and computer-readable instructions that, when executed by the processor, cause the processor to perform processes comprising:

causing the imaging device to capture a first image, the first image being an image including the first stitches formed on the first work cloth based on the first stitch data;

identifying, based on the first stitch data and on first image data, a position and an angle, in relation to the contour, of at least two feature points on the first work cloth, the at least two feature points being inside the contour, the first image data being image data of the first image;

causing the imaging device to capture a second image, the second image being an image including the at least two feature points in the pattern, the pattern having been cut out from the first work cloth along the first stitches and being temporarily fixed at a desired position and angle on the second work cloth;

identifying, based on second image data and on the identified position and angle of the at least two feature points in relation to the contour, a position and an angle of the contour in relation to the second work cloth, the second image data being image data of the second image; and correcting the second stitch data in accordance with the identified position and angle of the contour in relation to the second work cloth.

4. The sewing machine according to claim 3, wherein the sewing data further includes third stitch data, the third stitch data being data representing stitches of an additional pattern to be sewn by embroidery after the pattern is sewn onto the second work cloth, and the computer-readable instructions further cause the processor to perform a process of correcting the third stitch data in accordance with the identified position and angle of the contour in relation to the second work cloth.

5. A sewing machine comprising:

an imaging device configured to capture an image;

a processor; and a memory configured to store:

sewing data that includes at least first stitch data and second stitch data, the first stitch data being data to be used to form at least first stitches on a first work cloth, the first stitches being stitches that indicate a contour of a pattern, the second stitch data being data to be used to form second stitches, the second stitches being stitches that attach the pattern cut out from the first work cloth along the first stitches onto a second work cloth; and computer-readable instructions that, when executed by the processor, cause the processor to perform processes comprising:

causing the imaging device to capture a pattern image, the pattern image being an image including the pattern, the pattern having been cut out from the first work cloth and being temporarily fixed at a desired position and angle to the second work cloth, the pattern having been cut out along the first stitches formed on the first work cloth based on the first stitch data;

identifying, in a case where the first stitch data only includes contour data to be used to form the first stitches on the first work cloth, a position and an angle of the contour in relation to the second work cloth based on the first stitch data and on image data of the pattern image;

identifying, in a case where the first stitch data includes the contour data and internal pattern data to be used to form third stitches representing another pattern inside the contour, a position and an angle of the contour or the third stitches in relation to the second work cloth, based on the first stitch data and on the image data of the pattern image; and correcting the second stitch data in accordance with the identified position and angle of the contour or the third stitches in relation to the second work cloth.

6. The sewing machine according to claim 5, wherein the sewing data further includes third stitch data, the third stitch data being data representing stitches of an additional pattern to be sewn by embroidery after the pattern is sewn onto the second work cloth, and the computer-readable instructions further cause the processor to perform a process of correcting the third stitch data in accordance with the identified position and angle of the contour or the third stitches in relation to the second work cloth.

* * * * *